US010724199B2

(12) United States Patent
Jeanmaire et al.

(10) Patent No.: US 10,724,199 B2
(45) Date of Patent: Jul. 28, 2020

(54) WHARF CONSTITUTED BY ARCHED WALLS AND PLANE TIES

(71) Applicant: SOLETANCHE FREYSSINET, Rueil-Malmaison (FR)

(72) Inventors: Thierry Jeanmaire, Rueil-Malmaison (FR); Pierre Schmitt, Rueil-Malmaison (FR); Michel Coudry, Rueil-Malmaison (FR); Jean Michel Jeanty, Rueil-Malmaison (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 0 days.

(21) Appl. No.: 15/766,387

(22) PCT Filed: Oct. 5, 2016

(86) PCT No.: PCT/FR2016/052570
§ 371 (c)(1),
(2) Date: Apr. 6, 2018

(87) PCT Pub. No.: WO2017/060630
PCT Pub. Date: Apr. 13, 2017

(65) Prior Publication Data
US 2018/0313050 A1 Nov. 1, 2018

(30) Foreign Application Priority Data
Oct. 6, 2015 (FR) ..... 15 59499

(51) Int. Cl.
*E02D 29/02* (2006.01)
*E02D 5/10* (2006.01)
(Continued)

(52) U.S. Cl.
CPC ..... *E02D 5/10* (2013.01); *E02B 3/066* (2013.01); *E02B 3/068* (2013.01); *E02D 5/08* (2013.01);
(Continued)

(58) Field of Classification Search
CPC .. E02D 29/02; E02D 29/0241; E02D 29/0266
(Continued)

(56) References Cited

U.S. PATENT DOCUMENTS 4,050,254 A * 9/1977 Meheen ..... E02D 29/0266 405/285
4,407,612 A * 10/1983 van Weele ..... E02D 5/20 405/284
(Continued)

FOREIGN PATENT DOCUMENTS

DE 20 2006 021127 U1 11/2012
EP 0101350 2/1984
(Continued)

OTHER PUBLICATIONS

Machine Translation of Japanese document JP 2011-17184, pp. 10 (Year: 2011).*

*Primary Examiner* — Sunil Singh
(74) *Attorney, Agent, or Firm* — Workman Nydegger; Matthew D. Todd

(57) ABSTRACT

The invention relates to a retaining work (12) in ground (S), the work having a vertical front portion and separating a first portion of ground (S1) from a second portion of ground. The front portion (14) is in the form of juxtaposed arched walls (16), each arched wall (16) presenting a concave side facing the first portion of ground and a convex side facing the second portion of ground, and the retaining work (12) further includes a rear portion (20) comprising a plurality of wall elements (22) having their largest faces extending
(Continued)

vertically in the second portion of ground (S2), each wall element (22) being arranged between two adjacent arched walls (16) and extending transversely relative to the front portion (14).

15 Claims, 5 Drawing Sheets

(51) Int. Cl.

| | |
|---|---|
| ***E02D 5/08*** | (2006.01) |
| ***E02D 5/18*** | (2006.01) |
| ***E02D 17/04*** | (2006.01) |
| ***E02B 3/06*** | (2006.01) |
| ***E02D 27/30*** | (2006.01) |

(52) U.S. Cl.
CPC ..... *E02D 5/182* (2013.01); *E02D 17/04* (2013.01); *E02D 27/30* (2013.01); *E02D 29/0266* (2013.01); *E02D 2300/002* (2013.01)

(58) Field of Classification Search
USPC ..... 405/262, 274–281, 284–287
See application file for complete search history.

(56) References Cited

U.S. PATENT DOCUMENTS

| | | | | |
|---|---|---|---|---|
| 5,505,563 A * | 4/1996 | Curt | ..... | E02D 5/20 405/262 |
| 2009/0123237 A1 * | 5/2009 | Heindl | ..... | E02D 5/08 405/274 |

FOREIGN PATENT DOCUMENTS

| | | |
|---|---|---|
| EP | 0833987 | 4/1998 |
| EP | 2295648 | 3/2011 |
| FR | 1502707 | 11/1967 |
| FR | 2889608 | 2/2007 |
| JP | H08-193332 | 7/1996 |
| JP | 2011-17184 A * | 1/2011 |

* cited by examiner

WHARF CONSTITUTED BY ARCHED WALLS AND PLANE TIES

BACKGROUND OF THE INVENTION

The present invention relates to retaining works made in ground, and in particular to works that are to form the walls of wharves.

More particularly, the invention relates to a retaining work in ground having a front portion extending substantially vertically while separating a first portion of ground from a second portion of ground.

The invention is particularly advantageous when the levels of the first and second portions of ground are substantially different, e.g. when the difference in height between the first and second portions of ground is of the order of 15 meters (m) to 30 m.

This applies when the first portion of ground is situated under a body of water, the front portion of the retaining work then constituting a wharf wall also separating the body of water from the second portion of ground.

Traditionally, the front portion of such a retaining work is a plane wall, and part of the forces exerted by the second portion of ground on the front portion are taken up by elongate metal ties connecting the plane wall to a rear anchor curtain that is parallel to the plane wall and that is situated in the second portion of ground at a distance from the plane wall, thereby stabilizing the work. The rear anchor curtain may be situated at more than 50 m from the plane wall, and the metal ties may be positioned at a depth of about 5 m. Conventionally, work begins by making the plane wall and the anchor curtain in the second portion of ground. Thereafter, the volume of ground that extends over the distance between the plane wall and the rear curtain is dug out to the depth at which the metal ties are to be positioned.

It can thus be understood that the volume of ground that needs to be dug out in order to be able to put the metal ties into place is very large, particularly since the plane wall is of great length. Furthermore, after the metal ties have been put into place, it is necessary to put back the volume of ground that was previously dug out. In general, underground water is present, and its level needs to be lowered while the work is taking place.

Those successive operations of lowering the underground water and of moving earth, which require very large volumes of earth to be moved, are particularly lengthy, tedious, and expensive.

OBJECT AND SUMMARY OF THE INVENTION

An object of the invention is to remedy the above-mentioned drawbacks by proposing a retaining work that is simpler and quicker to make than the prior art work, and that does not require the above-mentioned earth-moving operations.

The invention achieves this object by the fact that the front portion is in the form of a juxtaposition of arched walls extending in a longitudinal direction that is vertical;

- each arched wall presenting a concave side facing the first portion of ground and a convex side facing the second portion of ground; and
- the retaining work further includes a rear portion connected to the front portion and comprising a plurality of wall elements having their largest faces extending vertically in the second portion of ground, each wall element being arranged between two adjacent arched walls and extending transversely relative to the front portion.

It can be understood that in a horizontal section plane the juxtaposed arched walls of the front portion present the form of a succession of arcs arranged side by side with the convex sides facing towards the first portion of ground.

The wall elements constitute plane ties that extend vertically from the surface of the ground to a predetermined depth. The wall elements are secured to the front portion over their full height. Their function is take up the forces to which the arched walls are subjected and they advantageously take the place of the elongate metal ties and the rear curtain of the prior art.

The wall elements are advantageously made going down from the surface of the ground. Consequently, unlike the prior art, in the invention the ties are put into place without it being necessary to dig out and then fill back a large quantity of earth. The invention thus makes it possible to make the retaining work much more quickly since the earth-moving operations are omitted.

Preferably, each wall element is arranged between two adjacent arched walls, extending orthogonally to the front portion.

Advantageously, the top level of the front portion corresponds substantially to the top level of the rear portion. In other words, the top faces of the arched walls are substantially at the same level as the top faces of the wall elements.

Advantageously, the front portion has two vertical end edges, and the rear portion also has two other wall elements extending transversely relative to the front portion and arranged on either side of said plurality of wall elements, extending from the vertical end edges of the front portion.

Advantageously, the wall elements are plane. Preferably, the front portion presents a longitudinal direction and the wall elements are perpendicular to said longitudinal direction of the front portion.

Advantageously, the wall elements are parallel to one another. Preferably, the wall elements are regularly spaced apart from one another.

In an advantageous aspect of the invention, the wall elements present a greatest height that is strictly less than the height of the front portion. In other words, the depth of the wall elements is strictly less than the depth of the front portion.

Thus, over the height of the wall elements, the retaining work of the invention behaves like a single-piece structure; each arched wall making up the front portion works as an arch like a circular wall that is held in position at its ends by the wall elements, which work as plane ties. The above assembly, by including the volume of ground contained between the wall elements, thus operates in a manner similar to a "gravity" wall. This makes it possible to reduce significantly the magnitudes of the bending moments applied to the front portion, and to reduce the values of its movements. In addition, below the wall elements, the retaining work behaves like a conventional plane wall.

In other words, the retaining work of the invention presents hybrid behavior.

Preferably, the height of the front portion is substantially equal to twice the greatest height of the wall elements. In the meaning of the invention, "height" is considered along a direction that is vertical, while the "length" of the wall elements is considered along a direction that is horizontal.

The greatest height of the wall elements may be constant over the entire length of said wall elements. Nevertheless, and in advantageous manner, at least one of the wall elements, when considered lengthwise, has a first end connected to the front portion and a second end opposite from the first end, and the height of the wall element decreases going from the first end towards the second end of said wall element. This decreasing height presents the advantage of reducing the concentration of stresses at the junction between the wall elements and the arched walls that are immediately adjacent thereto. Another advantage is to accompany the diffusion of traction stresses along the wall elements acting as plane ties. Yet another advantage is to reduce the quantity of material needed to make the rear wall, thereby enabling the cost of the retaining work to be reduced. Preferably, the profile of the bottom face of each wall element is staircase-shaped.

Preferably, the length of the wall elements is greater than the greatest height of said wall elements.

Advantageously, the distance between two adjacent wall elements is less than the length of a wall element. Preferably, the distance between two adjacent wall elements is substantially equal to half the length of a wall element. An advantage is to improve the take-up of forces by the rear portion of the retaining work.

In a preferred embodiment, at least two arched walls are connected to each other and to one of the wall elements by a coupling element that presents a first connection portion connected to the wall element and second and third connection portions that are connected to the two arched walls. It can be understood that the arched walls act on the coupling element in compression.

Advantageously, the front and/or rear portions are made of reinforced concrete.

In preferred manner, the arched walls include reinforcing cages that are arranged beside one another. In addition, when the rear portion also contains reinforcement, the reinforcement is connected to the reinforcing cages of the first portion, preferably via coupling elements, so as to obtain structural continuity between the reinforcement in the front and rear portions.

In a first embodiment, the front portion and/or the rear portion is a diaphragm wall. When the front portion is a diaphragm wall, at least some of the arched walls are preferably constituted by juxtaposing plane unit screens that are arranged in a circular arc. Diaphragm walls are conventionally made up of alternating or successive individual panels. It is possible to use shuttering at the ends, as described in Document EP 0 101 350. Alternatively, using tooling of the wall cutter type, the panels may be connected together by biting into the concrete of the already-cast panel.

In a second embodiment, the front portion is made of reinforced concrete while the wall elements comprise sheet piling.

In another variant, the rear portion is made using a soil-mixing technique, combining a step of excavating a trench and mixing the soil in situ in the trench with a binder. Optionally, sheet piling may then be placed in the trench.

In yet another variant, the rear portion is made using the slurry wall technique, which is known from elsewhere, with reinforcement optionally being installed therein.

The present invention also provides a wharf including at least one retaining work of the invention, wherein the first portion of ground is situated under the bottom of a body of water such that the front portion also separates the body of water from the second portion of ground.

The wharf may be a sea wharf, a river wharf, or any other type of wharf in contact with a body of water.

Preferably, but not necessarily, the bottom of the body of water lies between the bottom level of the rear portion and the bottom end level of the front portion.

Advantageously, the wharf of the invention further includes a first rail that extends transversely relative to the wall elements of the rear portion while being supported by a plurality of said wall elements, and the wharf further includes a second rail parallel to the first rail.

These two rails constitute a track enabling freight handling cranes, such as container gantries, to move parallel to the longitudinal direction of the front portion of the work.

Preferably, the first rail is preferably fastened to the wall elements.

Preferably, but not exclusively, the second rail is supported by the front portion. Thus, by means of the invention, the first and second rails are supported by the retaining work. The rails are preferably also secured to the retaining work. Consequently, the wall elements form "sleepers" or ties for the rails, thereby ensuring that they are maintained at a constant gauge.

In addition, the weight of the container gantry is advantageously taken up by the retaining work, thus presenting the advantages both of reducing the vertical forces that need to be taken into account when designing the front portion and also of avoiding any risk of differential movements between the two rails, as can happen with prior art retaining works.

BRIEF DESCRIPTION OF THE DRAWINGS

The invention can be better understood on reading the following description of embodiments of the invention given as non-limiting examples, and in which.

DETAILED DESCRIPTION OF THE INVENTION

Figure 1:
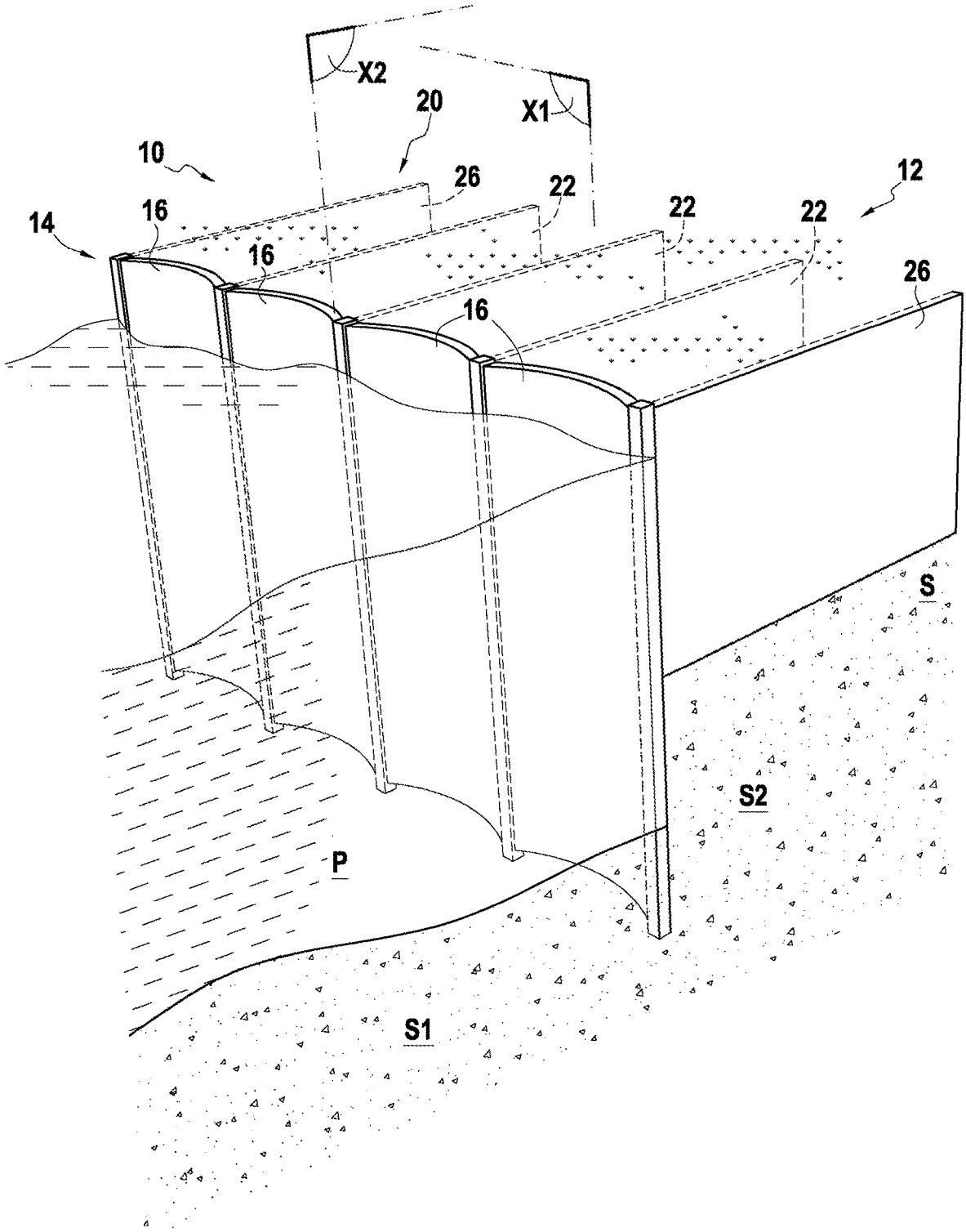
FIG. 1 is a perspective view of a wharf of the invention constituted by a retaining work in a first embodiment of the invention.

FIG. 1 shows a wharf 10 of the invention including a first embodiment of a retaining work 12 in ground S. The retaining work 12 has a front portion 14 that extends substantially vertically and that separates a first portion of ground S1 from a second portion of ground S2.

Figure 2:
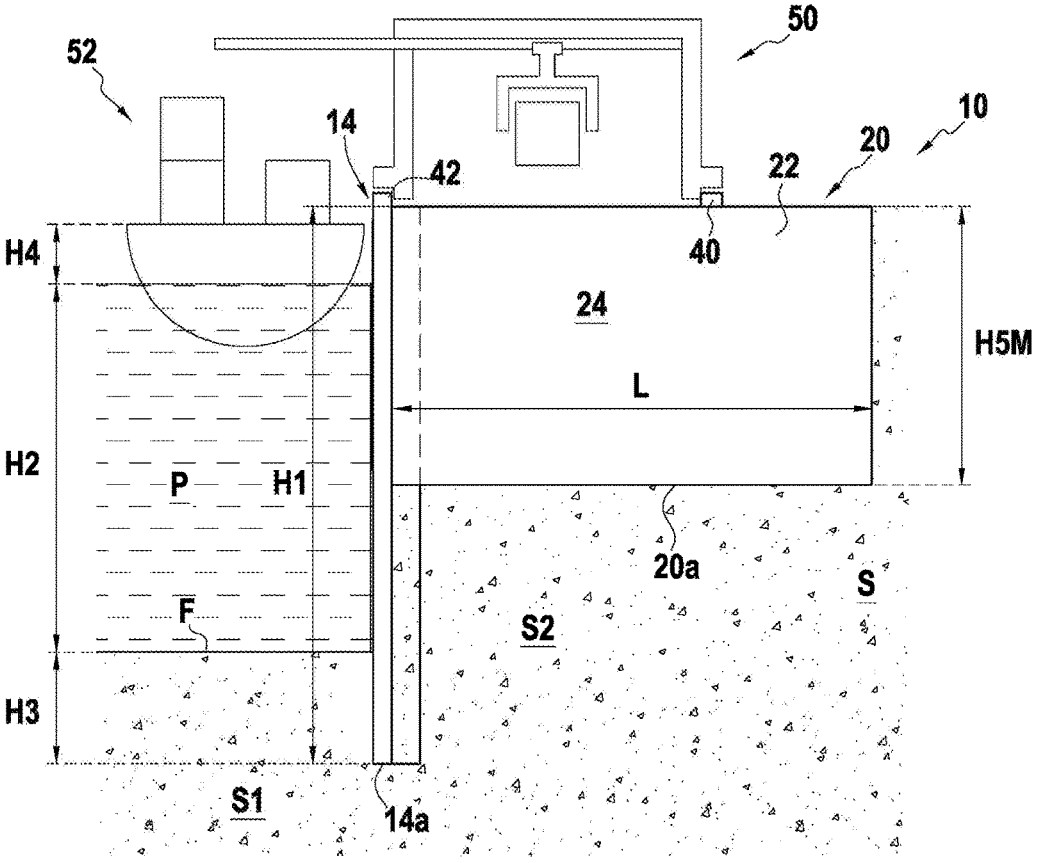
FIG. 2 is a side view in section of the FIG. 1 wharf, showing a container gantry installed on a pair of rails supported by the retaining work.

With reference to FIGS. 1 and 2, it can be seen that the first portion of ground S1 is situated under the bottom F of a body of water P, and that the front portion 14 presents a depth that is greater than the depth of the water. It can thus be understood that the front portion 14 of the retaining work 12 also separates the body of water P from the second portion of ground S2.

It can be understood that the front portion 14 of the retaining work constitutes a retaining wall having a function of preventing the second portion of ground collapsing into the water P.

As can be in FIG. 2, the height H1 of the front portion 14 of the retaining work 12 is strictly greater than the height H2 of the body of water P, it being understood that the height H2 of the body of water P is defined as the distance between the bottom F and the surface of the body of water P. More precisely, the front portion 14 of the retaining work 12 extends vertically below the bottom F of the body of water P over a height H3. The front portion 14 of the retaining work 12 thus separates the portion of ground S1 from the second portion of ground S2 over this height H3.

Furthermore, the front portion 14 of the retaining work 12 extends vertically above the surface of the body of water P over a height H4.

In this non-limiting example, the height H1 of the front portion 12 is 43 m, the height H2 of the body of water is about 25 m, the height H4 of the portion of the front portion 14 that is above water is about 6 m. Finally, the height H3 of the portion of the front portion 14 that is below the bottom of the body of water P is about 12 m.

Figure 3:
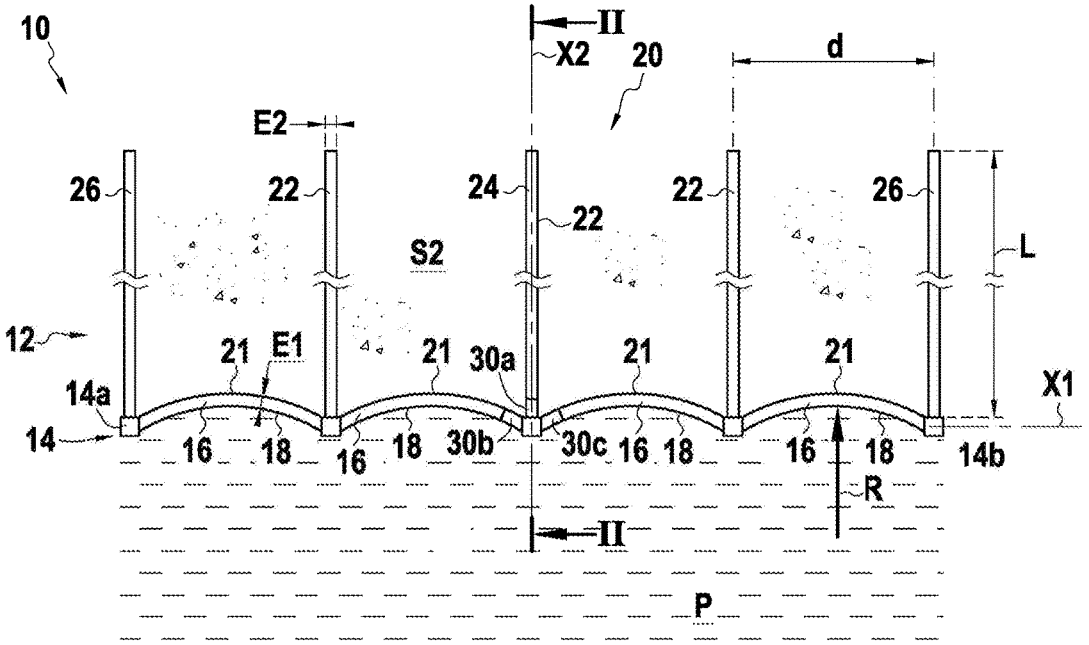
FIG. 3 is a plan view of the FIG. 1 wharf.

In accordance with the invention, the front portion 14 of the retaining work 12 is in the form of juxtaposed arched walls 16 that extend in a longitudinal direction that is vertical. The arched walls are in alignment being arranged side by side so as to form a continuous wall extending in a mean vertical plane X1 that extends along the longitudinal direction of the front portion. As shown in FIG. 3, each arched wall 16 has a cross-section in a horizontal plane that is generally in the form of an arc of a circle.

Each arched wall 16 has a concave side 18 facing the first portion of ground S1 and also the body of water P. Each arched wall 16 also presents a convex side 21, opposite its concave side 18, and facing the second portion of ground S2.

In this example, each arched wall 16 presents a thickness E1 that is of the order of 1 m. It can also be understood that each arched wall 16 extends vertically from the surface over substantially the entire height H1 of the front portion 14 of the retaining work 12. Still in this example, each arched wall 16, when considered in a horizontal plane, presents a radius of curvature R that is of the order of 15 m.

The retaining work 12 also has a rear portion 20 that is secured to the front portion 14 so as to form a single-piece structure. The rear portion 20 comprises a plurality of wall elements 22 formed in the ground and extending vertically from the surface of the ground down to a predetermined depth. It can thus be understood that the large faces 24 extend vertically in the second portion of ground S2. In the first embodiment shown in FIG. 2, the large faces 24 of the wall elements 22 are substantially plane and rectangular in shape.

With reference to FIG. 2, it can be seen that the top level of the front portion corresponds substantially to the top level of the rear portion. In other words, the wall elements 22, 26 extend vertically from the top level of the front portion. Furthermore, the wall elements 22 are secured to the front portion 14 over their full height.

As can be seen in FIG. 3, each wall element 22 is secured to the front portion by being arranged between two adjacent arched walls 16, while extending transversely relative to the front portion 14. More precisely, in this first embodiment, the wall elements 22 extend in vertical planes X2 that are perpendicular to the mean plane X1 in which the front portion 14 of the retaining work 12 extends.

Furthermore, the wall elements 22 are parallel to one another, with the distance d between two successive wall elements 22 being about 15 m.

In this first embodiment, the front portion 14 has two vertical edges 14*a* and 14*b* that are opposite from each other, as shown in FIG. 3. The rear portion 20 also has two other wall elements 26 that are likewise transverse relative to the front portion 14 and that are arranged on either side of the plurality of wall elements 22. These other wall elements 26 extend from the end edges 14*a* and 14*b* of the front portion 12 so that all of the wall elements 22, 26 are parallel to one another.

More precisely, in this first embodiment, the wall elements 22, 26 are identical and parallel to one another, so that it is only a wall element 22 as shown in FIG. 2 that is described.

Advantageously, the wall elements 22, 26 present a greatest height H5M, that, in this example, is constant over the entire length of the wall elements. In addition, all of the wall elements 22, 26 present the same greatest height. Nevertheless, the wall elements could present different greatest heights without going beyond the ambit of the present invention.

The greatest height H5M is strictly less than the height H1 of the front portion 14. Furthermore, the depth of the wall elements 22, 26 is strictly less than the depth of the front portion 14.

This configuration has the effect that along the height H5M the retaining work behaves like a circular wall, whereas below the wall elements 22, 26, the retaining work behaves like a plane wall.

Furthermore, in the example of FIG. 2, it can be seen that the level of the bottom F of the body of water P lies between the bottom level 14*a* of the front portion 14 and the bottom level 20*a* of the rear portion 20. The bottom level 14*a* of the front portion 14 corresponds to the bottom ends of the arched walls, while the bottom level of the rear portion corresponds to the bottom faces of the wall elements 22, 26.

In this example, the height H1 of the front portion is substantially equal to twice the greatest height H5M of the wall elements 22, 26. In this example, the wall elements extend along a length L that is oriented horizontally. The length L of the wall elements 22, 26 is greater than the greatest height H5M of said wall elements, as shown in FIG. 2.

Furthermore, the distance d between adjacent wall elements 22, 26 is substantially equal to half the length L of the wall elements 22, 26. Such a configuration serves to improve the retaining properties of the retaining work of the invention.

With reference once more to FIG. 3, it can be seen that at least two adjacent arched walls 16 are connected to each other and to one of the wall elements 22 by a coupling element 30 that presents a first connection portion 30*a* connected to the wall element 22 and first and second connection portions 30*b* and 30*c* connected to two adjacent arched walls. The coupling element 30 serves to facilitate connecting together the arched walls and the connecting elements.

With reference once more to FIG. 2, it can be seen that the wharf 10 further includes a first rail 40 and a second rail 42 parallel to the first rail 40 and on which a container gantry 50 can move parallel to the front portion 14 in order to load a container ship 52.

The first rail 40 extends across the wall elements 22, 26 while being supported by said wall elements 22, 26. The second rail 42 is supported in this example by the front portion 14. Without going beyond the ambit of the present invention, the second rail 42 could also be supported by the wall elements 22, 26. In this example, the first and second rails 40 and 42 are fastened to the retaining work 12.

Figure 4:
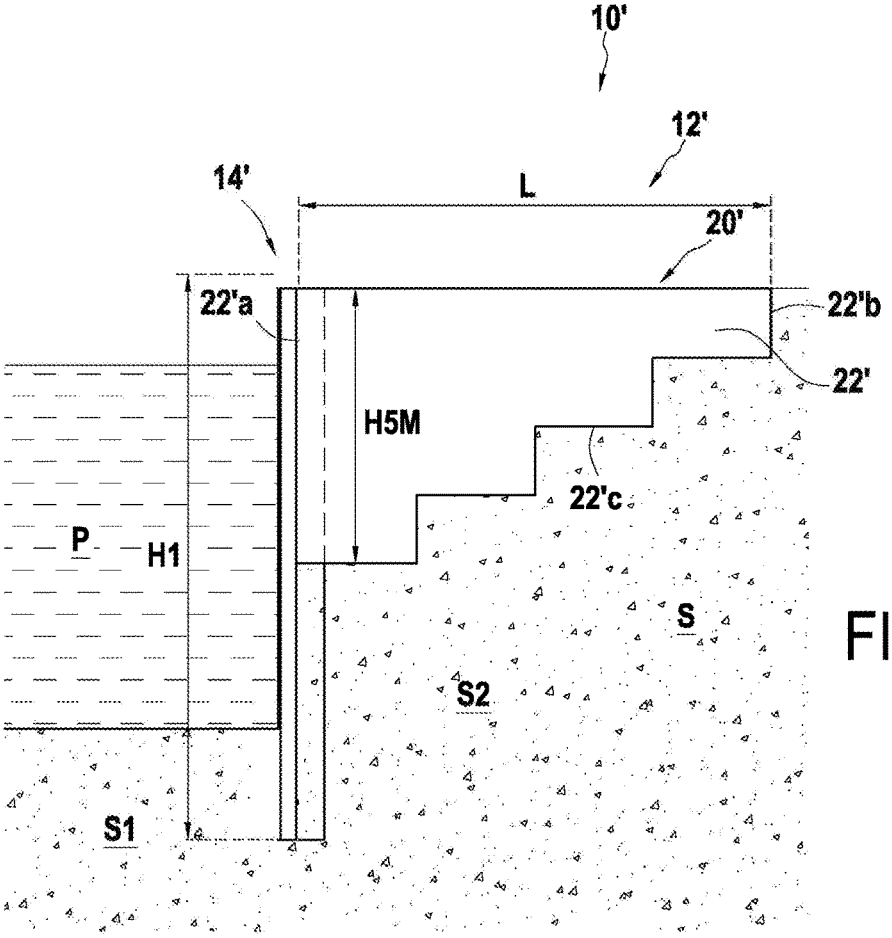
FIG. 4 is a side view in section of a variant of the FIG. 1 wharf comprising a retaining work in a second embodiment of the invention.

FIG. 4 shows another wharf 10' of the invention that presents a retaining work 12' in a second embodiment of the invention.

Considered along its length L, each wall element 22' has a first end 22'*a* that is connected to the front portion 14' and a second end 22'*b* that is opposite from the first end 22'*a*.

In this second embodiment, the retaining work 12' differs from the first embodiment by the fact that the wall elements 22' of the rear portion 20' present height that is not uniform.

As shown in FIG. 4, considered along the length of the wall element, the height of said wall element 22 decreases going from the first end 22'*a* towards the second end 22'*b* of the wall element 22. In the example of FIG. 4, the bottom face 22'*c* of the wall element 22' presents a staircase-shape, with the greatest height H5M of the wall element 22' being in the proximity of the front portion 14'.

There follows a description of a method of making the above-described wharves.

By way of example, in order to make the wharf 10, it is the front portion 14 of the retaining work 12 that is made initially. For this purpose, a diaphragm wall of depth H1 is formed in the ground S of cross-section in a horizontal plane that presents the form of a succession of arches, as shown in FIG. 3. This diaphragm wall is made of reinforced concrete. For this purpose, it is possible to use a drilling tool such as that described in EP 2 295 648.

Thereafter, or simultaneously, the wall elements 22, 26 are formed either in the form of diaphragm walls, or else by excavating using a soil-mixing technique in which sheet piling is inserted. For this purpose, it is possible to use a drilling and mixing tool, such as that described in FR 2 889 608. The coupling elements 30 are also placed between the wall elements 22 and the arched walls 16.

Figure 6:
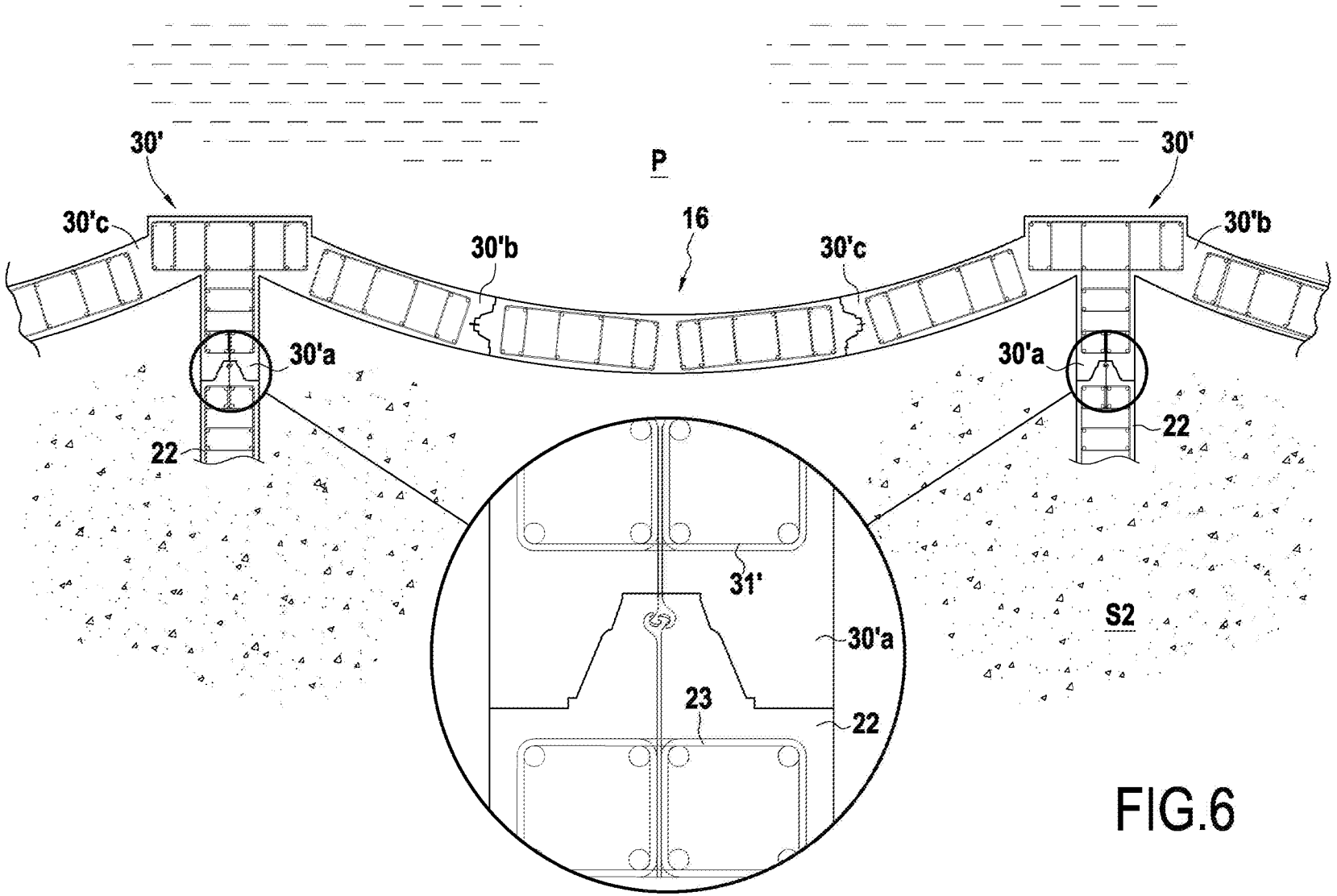
FIG. 6 is a plan view in section of the wharf in the first embodiment of the invention.
Figure 7:
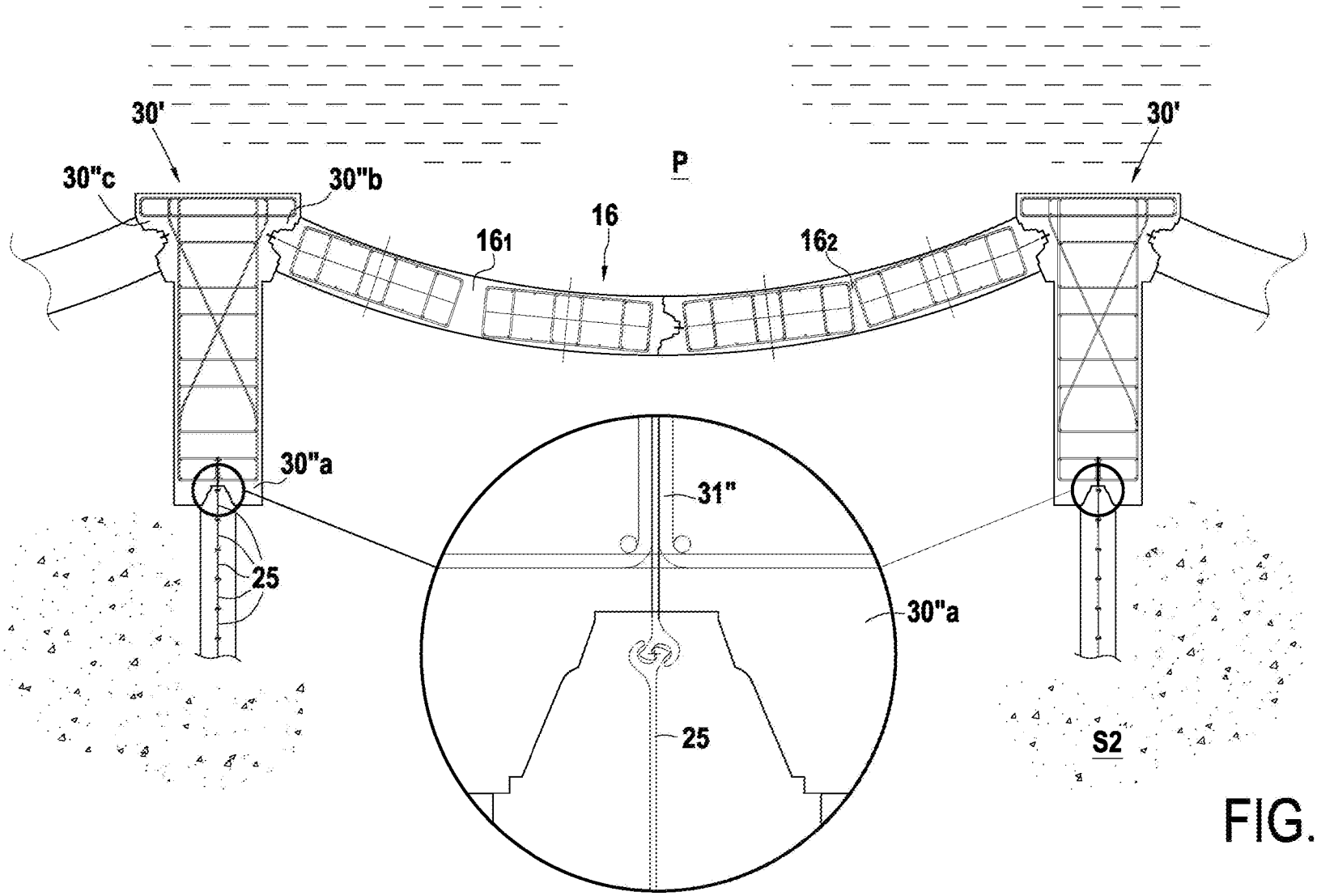
FIG. 7 is a plan view in section of the wharf in the second embodiment of the invention.

In the examples of FIGS. 6 and 7, the coupling elements 30', 30" are constructed using the tooling used for making the front portion.

By way of example, this comprises diaphragm wall tooling using shuttering such as that described in Document EP 0 101 350, serving to make connections between the coupling elements and the arched walls.

FIG. 6 shows a first embodiment of coupling elements 30'. In this first element, the first connection portion 30'*a* is coupled with the wall element 22 by co-operating shapes. In this first element, the wall element 22 is made as a diaphragm wall with continuous reinforcement, as described in Document EP 0 833 987, for example. It can be seen that the reinforcing cage 31' of the coupling element 30' is connected with the reinforcing cage 23 of the wall element 22. Each of the second and third connection portions 30'*b* and 30'*c* is also provided with a reinforcing cage in the form of a connection arm that is coupled with one of the arched walls 16 by co-operating shapes.

In the second embodiment shown in FIG. 7, the coupling element 30" is similar to that of FIG. 6, except that the second and third connection portions 30"*b* and 30"*c* are in the form of setbacks and not of connection arms. The arched wall 16 that is connected to the second connection portion 30"*b* is constituted by two interconnected unitary elements $\mathbf{16}_1$ and $\mathbf{16}_2$.

Furthermore, in this second embodiment, the wall element 22 has sheet piling curtain elements 25 connected to the reinforcing cage 31" of the coupling element 30". This sheet piling curtain (e.g., a plurality of interlocking steel sheet piling members) may be rammed directly into the ground, or it may be put into place in an excavation using the soil-mixing technique, as described above, or indeed it may be a slurry wall, as is well known from elsewhere.

In order to make the wall elements 22' of the second embodiment of FIG. 4, four adjacent trenches are dug of respective heights that decrease going from the first end 22'*a* to the second end 22'*b*. This produces the staircase-shape shown in FIG. 4.

Figure 5A:
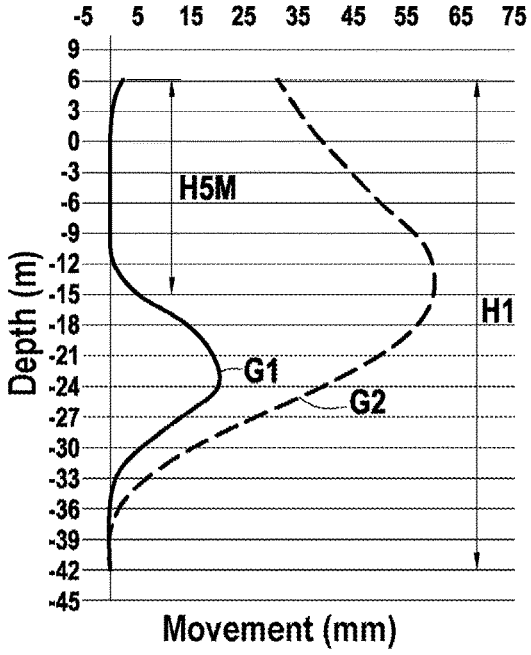
FIGS. 5A and 5B are comparative graphs showing the values for movement and for bending moments as a function of depth.

In FIG. 5A, the curve G1 shows the movement in millimeters of the retaining work 12 of FIG. 1 as a function of depth, measured from the surface of the body of water P. The curve G2 shows the movement of a prior art retaining work as described above.

Figure 5B:
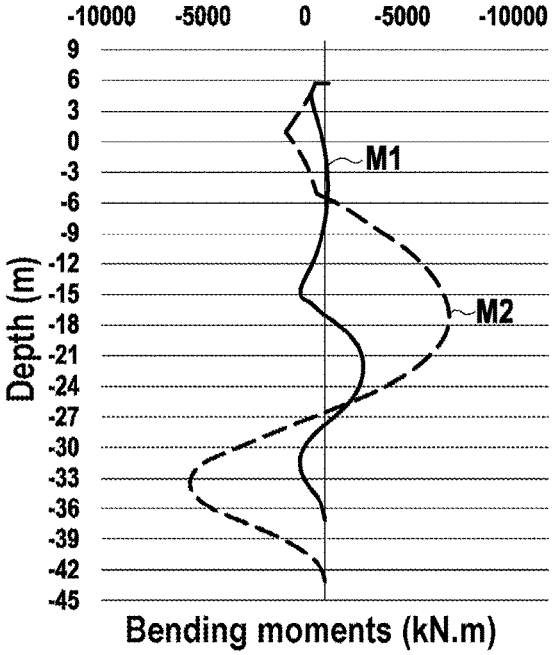

In FIG. 5B, the curve M1 shows the values of the bending moments to which the retaining work 10 of FIG. 1 is subjected as a function of depth. The curve M2 shows the values of the bending moments to which the above-described prior art retaining work is subjected.

Calculation shows that the retaining work of the invention presents movements and bending moments that present absolute values that are significantly smaller than those of the prior art work.

The invention claimed is:

1. A retaining work in ground, the work having a front portion that extends substantially vertically while separating a first portion of ground from a second portion of ground, wherein:

the front portion is in the form of a juxtaposition of arched walls extending in a longitudinal direction that is vertical; wherein each arched wall presents a concave side facing the first portion of ground and a convex side facing the second portion of ground; and wherein the retaining work further includes a rear portion connected to the front portion and comprising a plurality of wall elements having their largest faces extending vertically in the second portion of ground, each wall element being arranged between two adjacent arched walls and extending transversely relative to the front portion, wherein the wall elements present a greatest height that is strictly less than the height of the front portion, and wherein the front portion is made of reinforced concrete while the wall elements comprise sheet piling, the sheet piling comprising a plurality of interlocking steel sheet piling members.

2. The retaining work according to claim 1, wherein the front portion has two vertical end edges, and wherein the rear portion also has two other wall elements extending transversely relative to the front portion and arranged on either side of said plurality of wall elements, extending from the vertical end edges of the front portion.

3. The retaining work according to claim 1, wherein the wall elements are plane.

4. The retaining work according to claim 1, wherein the wall elements are parallel to one another.

5. The retaining work according to claim 1, wherein the height of the front portion is substantially equal to twice the greatest height of the wall elements.

6. The retaining work according to claim 1, wherein at least one of the wall elements, when considered lengthwise, has a first end connected to the front portion and a second end opposite from the first end, and wherein the height of the wall element decreases between the first end and the second end of said wall element.

7. The retaining work according to claim 1, wherein the length of the wall elements is greater than the greatest height of said wall elements.

8. The retaining work according to claim 1, wherein the distance between two adjacent wall elements is less than the length of a wall element.

9. The retaining work according to claim 1, wherein at least two of said arched walls are adjacent and connected to each other and to one of the wall elements by a coupling element that presents a first connection portion connected to the wall element and second and third connection portions that are connected to the two adjacent arched walls.

10. The retaining work according to claim 1, wherein the front and/or rear portions are made of reinforced concrete.

11. The retaining work according to claim 1, wherein the front portion and/or the rear portion is a diaphragm wall.

12. A wharf including:

a retaining work in ground, the work having a front portion that extends substantially vertically while separating a first portion of ground from a second portion of ground, wherein:

the front portion is in the form of a juxtaposition of arched walls extending in a longitudinal direction that is vertical; wherein each arched wall presents a concave side facing the first portion of ground and a convex side facing the second portion of ground; and wherein the retaining work further includes a rear portion connected to the front portion and comprising a plurality of wall elements having their largest faces extending vertically in the second portion of ground, each wall element being arranged between two adjacent arched walls and extending transversely relative to the front portion;

and wherein the first portion of ground is situated under the bottom of a body of water such that the front portion separates the body of water from the second portion of ground;

wherein the wharf further includes a first rail that extends transversely relative to the wall elements of the rear portion while being supported by a plurality of said wall elements, and wherein the wharf further includes a second rail parallel to the first rail.

13. The wharf according to claim 12, wherein the second rail is supported by the front portion.

14. The wharf according to claim 12, wherein the wall elements present a greatest height that is strictly less than the height of the front portion.

15. A retaining work in ground, the work having a front portion that extends substantially vertically while separating a first portion of ground from a second portion of ground, wherein:

the front portion is in the form of a juxtaposition of arched walls extending in a longitudinal direction that is vertical; wherein each arched wall presents a concave side facing the first portion of ground and a convex side facing the second portion of ground; and wherein the retaining work further includes a rear portion connected to the front portion and comprising a plurality of wall elements having their largest faces extending vertically in the second portion of ground, each wall element being arranged between two adjacent arched walls and extending transversely relative to the front portion, and wherein the wall elements present a greatest height that is strictly less than the height of the arched walls and wherein the front portion is made of reinforced concrete while the wall elements comprise sheet piling, the sheet piling comprising a plurality of interlocking steel sheet piling members.

* * * * *